US007955094B2

(12) United States Patent
Lu

(10) Patent No.: US 7,955,094 B2
(45) Date of Patent: Jun. 7, 2011

(54) DVI CONNECTOR WITH PROTECTIVE STRUCTURE

(75) Inventor: Ching-Tung Lu, Banciao (TW)

(73) Assignee: Fen Yeng Enterprises Co., Ltd. (TW)

( * ) Notice: Subject to any disclaimer, the term of this patent is extended or adjusted under 35 U.S.C. 154(b) by 0 days.

(21) Appl. No.: 12/662,383

(22) Filed: Apr. 14, 2010

(65) Prior Publication Data

US 2011/0097910 A1 Apr. 28, 2011

(30) Foreign Application Priority Data

Oct. 27, 2009 (TW) ..... 98219778 U

(51) Int. Cl.
*H01R 12/00* (2006.01)

(52) U.S. Cl. ..... 439/79; 439/541.5

(58) Field of Classification Search ..... 439/79, 439/80, 541.5, 540.1, 567, 607.21, 607.24, 439/607.25, 638, 924.1, 892
See application file for complete search history.

(56) References Cited

U.S. PATENT DOCUMENTS 6,095,853 A * 8/2000 Huang et al. ..... 439/541.5
6,159,040 A * 12/2000 Chang et al. ..... 439/541.5
6,210,218 B1 * 4/2001 Chang ..... 439/567
7,402,078 B2 * 7/2008 Wan et al. ..... 439/607.01
7,517,232 B2 * 4/2009 Yuan et al. ..... 439/79
7,677,923 B1 * 3/2010 Chen et al. ..... 439/541.5
7,699,626 B2 * 4/2010 Lu et al. ..... 439/79
2005/0059296 A1 * 3/2005 Wang ..... 439/541.5
2005/0095908 A1 * 5/2005 Xue et al. ..... 439/541.5
2007/0232131 A1 * 10/2007 Ju ..... 439/541.5
2007/0243757 A1 * 10/2007 Wan et al. ..... 439/541.5
2008/0318452 A1 * 12/2008 Lin ..... 439/79

* cited by examiner

*Primary Examiner* — T C Patel
*Assistant Examiner* — Harshad C Patel
(74) *Attorney, Agent, or Firm* — Bacon & Thomas, PLLC

(57) ABSTRACT

The present invention is to provide a DVI connector, which includes a frame fixed to a circuit board, a connection head fixed on the frame and having a plurality of through holes, a plurality of first and second connection terminals passing through the corresponding through holes for transmitting high-frequency digital signals and low-frequency analog signals, respectively, and a protective element made of a material with a high dielectric constant, wherein the protective element is fixedly provided on the frame and formed with a plurality of terminal spaces, the terminal spaces are parallel to and spaced apart from one another for being passed through by the corresponding connection terminals. Since no two horizontally adjacent first connection terminals are passed through the same terminal space, it can effectively avoid the high-frequency signals transmitted by the first connection terminals from decaying or being interfered.

12 Claims, 5 Drawing Sheets

DVI CONNECTOR WITH PROTECTIVE STRUCTURE

FIELD OF THE INVENTION

The present invention relates to a DVI (Digital Visual Interface) connector, more particularly to a DVI connector having a protective element, wherein the protective element is made of a material with a high dielectric constant and formed with a plurality of parallel terminal spaces for allowing corresponding connection terminals to pass through, respectively, so as to prevent high-frequency digital signals transmitted by the connection terminals from decaying or being interfered.

BACKGROUND OF THE INVENTION

With the advent of the digital era, practically all data nowadays—be they texts, pictures, voice recordings, videos, moving pictures, or otherwise—can be digitized or, in other words, converted into information in the digital format. The extensive use of digitization is attributable mainly to the following advantages of digital information:

(1) Data, once digitized, are transformed into binary codes consisting of "1" and "0". As binary codes are chiefly differentiated by electric potential and can be incorporated with checking codes, information in the digital format can be reproduced again and again without being distorted; that is to say, the original content will be precisely preserved. For instance, after a magnetic tape is copied many times in a row, the analog music data stored in the tape will be adulterated by a lot of noise, and consequently the quality of sound played back from the last copied tape is compromised. By contrast, digitized music data can be copied repeatedly without damaging the clarity of sound.

(2) Digital information is compressible to reduce its own file size and hence can be transmitted in a larger quantity than analog information within the same period of time. For example, a cable used for cable TV can deliver at most a hundred channels in the analog format per day but two hundred channels in the digital format thanks to the compressibility of digital information. Therefore, the equipment costs of cable TV service providers can be reduced if the digital format is adopted.

(3) Digital information can be directly encrypted so that a person who owns the right to the information can limit the authority of its reader or make the information accessible only to readers of a certain authority level. This feature allows the right owner to manage confidential files effectively.

As digital information has the various benefits stated above, there has been a trend to digitize all useful data around us. As a result, many of the existing connection interface formats that were originally intended only for the transmission of analog information become out of date, and the related industry is forced to develop and establish interface specifications designed specifically for information in the digital format. In particular, the Digital Visual Interface (DVI), which is a novel connection interface for display devices, uses digitized transmission to enhance the visual quality of display devices used with personal computers. More specifically, DVI employs the Transition Minimized Differential Signaling (TMDS) technology to transmit digital information and thereby ensure the transmission stability of high-speed serial data. Further, a DVI connector includes connection terminals for the traditional analog signals as well as connection terminals for digital signals and is hence equally applicable to digital screens and analog screens, thus increasing the convenience of use of DVI. Consequently, it is unnecessary for a consumer to replace a cathode ray tube (CRT) screen in good working condition with a digital one for the sole purpose of adapting to a DVI plug.

However, the conventional DVI connectors still have the following disadvantages in use:

(1) When transmitting high-frequency digital signals, a conventional DVI connector is subject to signal loss, leak, or interference, which impairs the quality of signal transmission.

(2) When a DVI plug is inserted into or pulled out of a conventional DVI connector, the connection terminals in the connector are easily displaced, thus resulting in poor electrical contact.

(3) In a conventional DVI connector, the thinnest connection terminal is no thicker than 0.3 mm. Therefore, if a factory worker trying to install a DVI connector on a circuit board fails to align the connection terminals of the connector with the corresponding through holes in the circuit board, the connection terminals are very likely to be bent. If the bent connection terminals are subsequently pulled back to their original positions, chances are the bent connection terminals will break, thus lowering the assembly yield of the connector.

Hence, it is an important subject for connector designers and manufacturers to develop a new connector structure capable of overcoming the aforesaid drawbacks of the prior art.

BRIEF SUMMARY OF THE INVENTION

In consideration of the foregoing, the inventor of the present invention conducted extensive research, performed related experiments, and finally succeeded in developing a DVI connector with a protective structure as an improvement over the conventional DVI connector. It is hoped that the present invention can effectively reduce the attenuation of high-frequency digital signals transmitted by DVI connectors and increase the overall strength of DVI connectors as well.

It is an object of the present invention to provide a DVI connector with a protective structure, wherein the DVI connector includes a frame, a connection head, a plurality of first connection terminals, a plurality of second connection terminals, and a protective element. The frame has a bottom fixedly provided with a plurality of fixing plates extending toward a first side of the frame so that the frame can be fixed to a circuit board via the fixing plates. The connection head is fixedly provided on a second side of the frame and has a plurality of through holes. The first connection terminals are configured to transmit high-frequency digital signals via the TMDS technology. Each first connection terminal has a first end received in a corresponding one of the through holes and a second end extending toward a portion of the bottom of the frame that is on the first side of the frame. The second connection terminals are configured to transmit low-frequency analog signals. Each second connection terminal has a first end received in a corresponding one of the through holes and a second end extending toward a portion of the bottom of the frame that is on the first side of the frame. The protective element is made of a material with a high dielectric constant, fixedly provided on the first side of the frame, and formed with a plurality of first terminal spaces and a second terminal space, wherein the terminal spaces are parallel to and spaced apart from one another. The first connection terminals are passed through the corresponding first terminal spaces, respectively, thus allowing the second ends of the first connection terminals to be electrically connected to the circuit board. Moreover, no two horizontally adjacent first connection terminals are passed through the same first terminal space. The second connection terminals are passed through the second terminal space so as for the second ends of the second connection terminals to be electrically connected to the circuit board. Thus, when a DVI plug is inserted into or pulled out of the DVI connector with improper application of force, the protective structure of the present invention can prevent the first connection terminals from being shifted. In addition, the protective element, which is made of a material having a high dielectric constant, can effectively prevent the high-frequency signals transmitted by the first connection terminals from leaking or being interfered.

It is another object of the present invention to provide the foregoing DVI connector, wherein the DVI connector further includes a reinforcing element installed at the second ends of the second connection terminals and located in the second terminal space. The reinforcing element serves to reinforce the second connection terminals and protect them from bending which may otherwise result from misalignment between the second ends of the second connection terminals and the corresponding through holes in the circuit board. Consequently, the overall assembly yield of the DVI connector is enhanced.

BRIEF DESCRIPTION OF THE SEVERAL VIEWS OF THE DRAWINGS

The invention as well as a preferred mode of use, further objects, and advantages thereof will be best understood by referring to the following detailed description of an illustrative embodiment in conjunction with the accompanying drawings, in which.

DETAILED DESCRIPTION OF THE INVENTION

Figure 1:
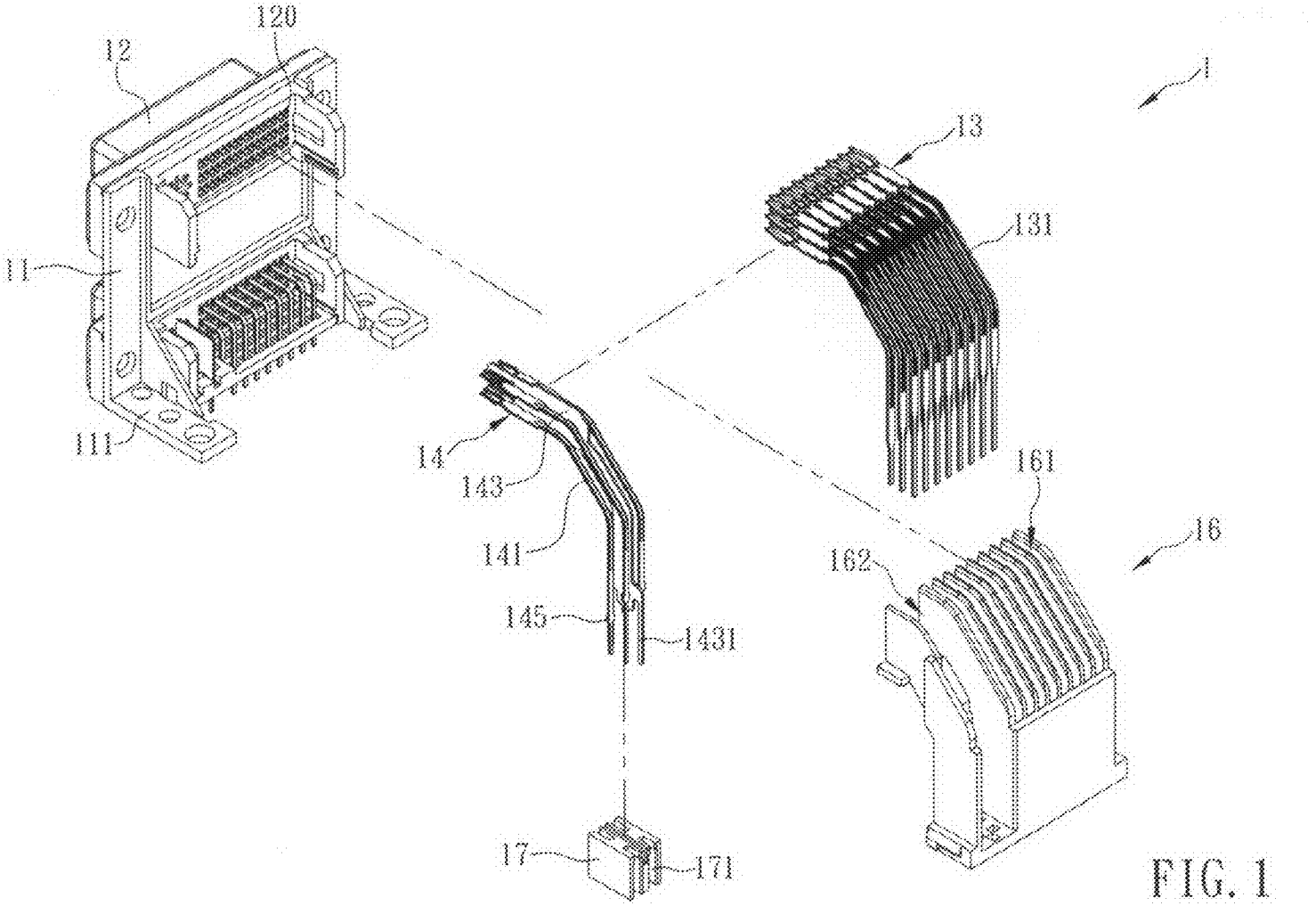
FIG. 1 is an exploded perspective view of a DVI connector according to an embodiment of the present invention.
Figure 2:
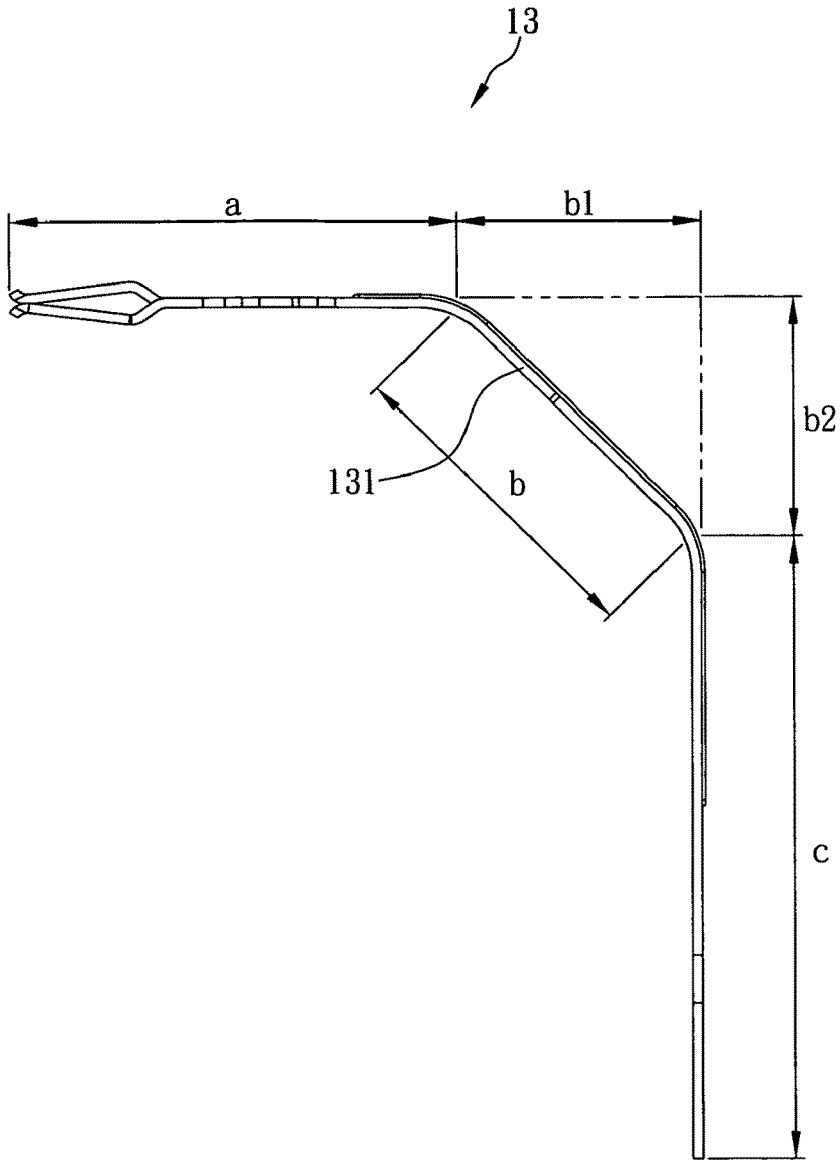
FIG. 2 schematically shows a first connection terminal.

The present invention provides a Digital Visual Interface (DVI) connector with a protective structure. Referring to FIG. 1, a DVI connector 1 according to an embodiment of the present invention includes a frame 11, a connection head 12, a plurality of first connection terminals 13, a plurality of second connection terminals 14, and a protective element 16. In the present embodiment, the frame 11 is H-shaped and has a bottom fixedly provided with a plurality of fixing plates 111 extending toward a first side of the frame 11. The fixing plates 111 can be fixed to a circuit board (not shown) by means of connecting elements such as screws and lances. In a different embodiment, however, the frame can be shaped according to practical needs, and the fixing plates may be integrally formed with the connecting elements. In short, the frame and the fixing plates are not limited to the aforesaid configurations. The connection head 12 is fixedly provided on a second side of the frame 11 and has a plurality of through holes 120 for connecting with a DVI plug (not shown). The first connection terminals 13 use the Transition Minimized Differential Signaling (TMDS) technology to transmit high-frequency digital signals. Each first connection terminal 13 has a first end received in a corresponding one of the through holes 120 and a second end extending toward a portion of the bottom of the frame 11 that is on the first side of the frame 11. In the present embodiment, in order to reduce the material used for making the first connection terminals 13, each first connection terminal 13 has a sloped end 131 between the first and second ends. Referring to FIG. 2, the first connection terminal 13 has a length of a between its first end and the sloped end 131, the sloped end 131 has a length of b, the length between the sloped end 131 and the second end of the first connection terminal 13 is c, and therefore the total length of the first connection terminal 13 is a+b+c. By contrast, the portion of a conventional connection terminal that corresponds to the sloped end 131 of the present invention is a bent portion consisting of two sides, as indicated by the dashed lines in FIG. 2, wherein the two sides have lengths b1 and b2, respectively, and form an included angle of 90 degrees. Hence, the total length of the conventional connection terminal is a+b1+b2+c. Since b must be shorter than b1+b2 in accordance with the triangle inequality, the first connection terminal 13 having the sloped end 131 according to the present invention uses less material than the conventional connection terminal that is bent into a right angle. In a different embodiment of the present invention, however, the conventional connection terminal can be used as the first connection terminal disclosed herein.

Referring again to FIG. 1, the second connection terminals 14 are configured to transmit low-frequency analog signals and each have a first end received in a corresponding one of the through holes 120 and a second end extending toward a portion of the bottom of the frame 11 that is on the first side of the frame 11. Like the first connection terminals 13, each second connection terminal 14 in the present embodiment is formed with a sloped end 141 between the first and second ends to save material. Nevertheless, the conventional right-angled connection terminals may also serve as the second connection terminals of the present invention. Furthermore, the protective element 16 is made of a material having a high dielectric constant such as 4 F/m or higher. The protective element 16 is fixedly provided on the first side of the frame 11 and formed with a plurality of first terminal spaces 161 and a second terminal space 162. The terminal spaces 161, 162 are parallel to and spaced apart from one another. The first connection terminals 13 are passed through the corresponding first terminal spaces 161, respectively, so as for the second ends of the first connection terminals 13 to penetrate the protective element 16 and be electrically connected to the circuit board. It should be noted that no two horizontally adjacent first connection terminals 13 are passed through the same first terminal space 161. In other words, the first connection terminals 13 in the same row are spaced apart from one another by the protective element 16. Thus, by disposing the first connection terminals 13 in the protective element 16 made of a material with a high dielectric constant, not only can attenuation of high-frequency digital signals be effectively reduced, but also the high-frequency digital signals are protected from leaking or being interfered.

Figure 3:
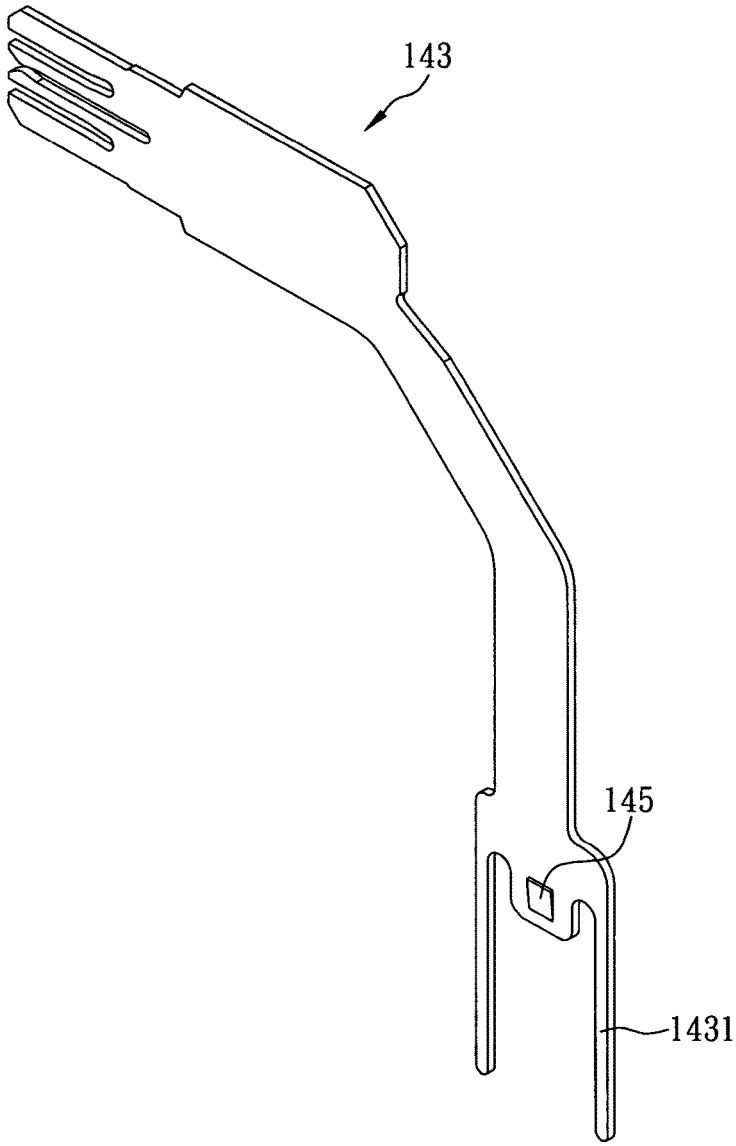
FIG. 3 schematically shows a second connection terminal.
Figure 4:
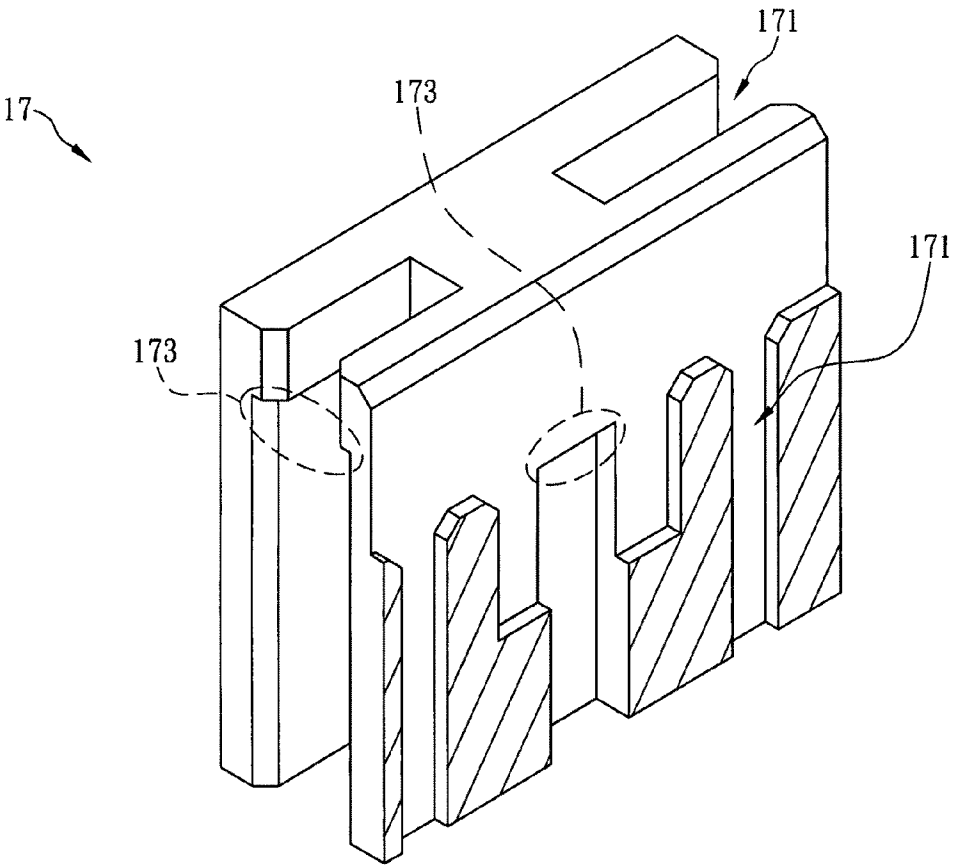
FIG. 4 is a sectional view of a reinforcing element.

With reference to FIG. 1, the second connection terminals 14 are passed through the second terminal space 162 so as for the second ends of the second connection terminals 14 to be inserted through the protective element 16 and electrically connected to the circuit board. Furthermore, according to the DVI specifications, one of the second connection terminals 14 is an analog ground terminal 143. The second end of this analog ground terminal 143 is stamped to form two pins 1431, as shown in FIG. 3, wherein each pin 1431 has a minimum thickness ranging from 0.25 mm to 0.35 mm. To prevent the pins 1431 from being accidentally bent during assembly, a reinforcing element 17 is additionally provided in the present embodiment. The reinforcing element 17 is located in the second terminal space 162 and formed with a plurality of pin spaces 171. By passing the second ends of the second connection terminals 14 through the corresponding pin spaces 171, the reinforcing element 17 is installed at the second ends of the second connection terminals 14. Referring to FIG. 4 for a sectional view of the reinforcing element 17, the pin spaces 171 of the reinforcing element 17 that correspond in position to the pins 1431 have minimum widths ranging from 0.3 mm to 0.4 mm. Therefore, even if the DVI connector 1 is offset from the predetermined insertion position while being mounted on the circuit board, thus subjecting the pins 1431 to the insertion force, the pins 1431 will be stopped by the internal walls of the corresponding pin spaces 171 of the reinforcing element 17 and protected from bending. As a result, the assembly yield of the DVI connector 1 is effectively raised.

As shown in FIGS. 1, 3, and 4, during the assembly of the DVI connector 1, the reinforcing element 17 is installed at the second ends of the second connection terminals 14 before the second connection terminals 14, together with the reinforcing element 17, are disposed in the second terminal space 162. Hence, in order to facilitate assembly and prevent the reinforcing element 17 from falling off, each second connection terminal 14 is provided, near the second end thereof, with at least one positioning plate 145. Each positioning plate 145 is configured to engage with and press against a corresponding shoulder 173 of the reinforcing element 17, as indicated by the dashed-line circles in FIG. 4. In consequence, the reinforcing element 17 is secured against falling off the second connection terminals 14, and smoothness of the assembly process ensured.

Figure 5:
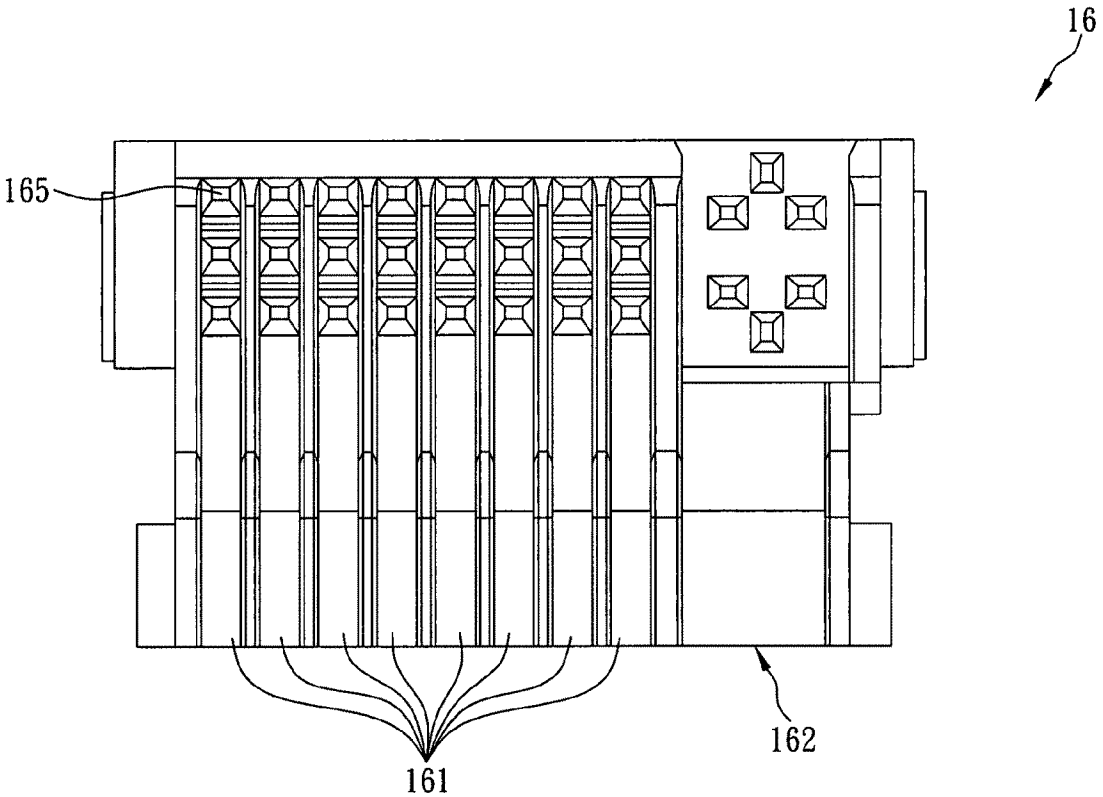
FIG. 5 is a top view of a protective element.

Please refer to FIG. 1 and FIG. 5, wherein FIG. 5 is a top view of the protective element 16. The protective element 16 is provided with a plurality of through holes 165 which are adjacent to a bottom of the first terminal spaces 161 and through which the second ends of the first connection terminals 13 are passed, respectively. Therefore, when a DVI plug (not shown) is inserted into or pulled out of the connection head 12, the second ends of the first connection terminals 13 and of the second connection terminals 14 are restrained by the protective element 16 and the reinforcing element 17, respectively, and hence are unlikely to be bent. Meanwhile, it is also unlikely for the first ends of the first connection terminals 13 and of the second connection terminals 14 to come out of the through holes 120 of the connection head 12. Thus, the service life of the DVI connector 1 is effectively extended. It should be particularly pointed out that the protective element 16 and the reinforcing element 17 are not limited to the aforementioned configurations and may be modified according to design needs, provided that the protective element 16 and the reinforcing element 17 have the structural features disclosed herein.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A Digital Visual Interface (DVI) connector with a protective structure, comprising:

a frame having a bottom fixedly provided with a plurality of fixing plates extending toward a first side of the frame, the fixing plates being fixed to a circuit board;

a connection head fixedly provided on a second side of the frame and formed with a plurality of through holes;

a plurality of first connection terminals configured to transmit high-frequency digital signals via Transition Minimized Differential Signaling (TMDS) technology, each said first connection terminal having a first end received in a corresponding said through hole and a second end extending toward a portion of the bottom of the frame that is on the first side of the frame;

a plurality of second connection terminals configured to transmit low-frequency analog signals, each said second connection terminal having a first end received in a corresponding said through hole and a second end extending toward a portion of the bottom of the frame that is on the first side of the frame;

a protective element made of a material with a high dielectric constant, fixedly provided on the first side of the frame, and formed with a plurality of first terminal spaces and a second terminal space, the first and second terminal spaces being parallel to and spaced apart from one another, the first connection terminals being passed through corresponding said first terminal spaces, respectively, so as for the second ends of the first connection terminals to be electrically connected to the circuit board, wherein the dielectric constant of the material making the protective element is 4 F/m or higher, and no two horizontally adjacent said first connection terminals are passed through a same said first terminal space, the second connection terminals being passed through the second terminal space so as for the second ends of the second connection terminals to be electrically connected to the circuit board; and a reinforcing element provided in the second terminal space and formed with a plurality of pin spaces, wherein the second ends of the second connection terminals are passed through corresponding said pin spaces, respectively, so as for the reinforcing element to be installed at and thereby reinforce the second ends of the second connection terminals.

2. The DVI connector of claim 1, wherein a sloped end is provided between the first end and the second end of each said first connection terminal.

3. The DVI connector of claim 2, wherein a sloped end is provided between the first end and the second end of each said second connection terminal.

4. The DVI connector of claim 3, wherein at least a positioning plate is provided on each said second connection terminal adjacent to the second end thereof, each said positioning plate being configured to engage with and press against a corresponding shoulder of the reinforcing element.

5. The DVI connector of claim 4, wherein the protective element is provided with a plurality of through holes adjacent to a bottom of the first terminal spaces, and the second ends of the first connection terminals are passed through corresponding said through holes of the protective element, respectively.

6. The DVI connector of claim 5, wherein the second end of one said second connection terminal is stamped to form two pins having minimum thicknesses ranging from 0.25 mm to 0.35 mm, and said pin spaces of the reinforcing element that correspond in position to the pins have minimum widths ranging from 0.3 mm to 0.4 mm.

7. A Digital Visual Interface (DVI) connector with a protective structure, comprising:

a frame having a bottom fixedly provided with a plurality of fixing plates extending toward a first side of the frame, the fixing plates being fixed to a circuit board;

a connection head fixedly provided on a second side of the frame and formed with a plurality of through holes;

a plurality of first connection terminals configured to transmit high-frequency digital signals via Transition Minimized Differential Signaling (TMDS) technology, each said first connection terminal having a first end received in a corresponding said through hole and a second end extending toward a portion of the bottom of the frame that is on the first side of the frame;

a plurality of second connection terminals configured to transmit low-frequency analog signals, each said second connection terminal having a first end received in a corresponding said through hole and a second end extending toward a portion of the bottom of the frame that is on the first side of the frame; and a protective element made of a material with a high dielectric constant, fixedly provided on the first side of the frame, and formed with a plurality of first terminal spaces and a second terminal space, the first and second terminal spaces being parallel to and spaced apart from one another, the first connection terminals being passed through corresponding said first terminal spaces, respectively, so as for the second ends of the first connection terminals to be electrically connected to the circuit board, wherein no two horizontally adjacent said first connection terminals are passed through a same said first terminal space, the second connection terminals being passed through the second terminal space so as for the second ends of the second connection terminals to be electrically connected to the circuit board; and a reinforcing element provided in the second terminal space and formed with a plurality of pin spaces, wherein the second ends of the second connection terminals are passed through corresponding said pin spaces, respectively, so as for the reinforcing element to be installed at and thereby reinforce the second ends of the second connection terminals.

8. The DVI connector of claim 7, wherein a sloped end is provided between the first end and the second end of each said first connection terminal.

9. The DVI connector of claim 8, wherein a sloped end is provided between the first end and the second end of each said second connection terminal.

10. The DVI connector of claim 9, wherein at least a positioning plate is provided on each said second connection terminal adjacent to the second end thereof, each said positioning plate being configured to engage with and press against a corresponding shoulder of the reinforcing element.

11. The DVI connector of claim 10, wherein the protective element is provided with a plurality of through holes adjacent to a bottom of the first terminal spaces, and the second ends of the first connection terminals are passed through corresponding said through holes of the protective element, respectively.

12. The DVI connector of claim 11, wherein the second end of one said second connection terminal is stamped to form two pins having minimum thicknesses ranging from 0.25 mm to 0.35 mm, and said pin spaces of the reinforcing element that correspond in position to the pins have minimum widths ranging from 0.3 mm to 0.4 mm.

* * * * *

UNITED STATES PATENT AND TRADEMARK OFFICE

CERTIFICATE OF CORRECTION

PATENT NO. : 7,955,094 B2
APPLICATION NO. : 12/662383
DATED : June 7, 2011
INVENTOR(S) : Ching-Tung Lu It is certified that error appears in the above-identified patent and that said Letters Patent is hereby corrected as shown below:

On the title page of the patent, "(73) Assignee: Fen Yeng Enterprises Co., Ltd. (TW)" should be (73) Assignee: Fen Ying Enterprises Co., Ltd. (TW).

Signed and Sealed this
Sixteenth Day of August, 2011

David J. Kappos

David J. Kappos
*Director of the United States Patent and Trademark Office*